United States Patent [19]

Dudas et al.

[11] 4,235,336

[45] Nov. 25, 1980

[54] FLASH ARRAY PACKAGE

[75] Inventors: Philip R. Dudas, South Euclid, Ohio; Laurence E. Boyce, Sr., Charlestown, Ill.

[73] Assignee: General Electric Company, Schenectady, N.Y.

[21] Appl. No.: 965,104

[22] Filed: Nov. 30, 1978

[51] Int. Cl.[3] ..... B65D 85/42; B65D 73/00; G03B 15/02

[52] U.S. Cl. ..... 206/419; 206/461; 206/462; 206/489; 362/11

[58] Field of Search ..... 206/419, 418, 489, 481, 206/471, 461, 462, 463; 362/11

[56] References Cited

U.S. PATENT DOCUMENTS

| | | | |
|---|---|---|---|
| 3,399,763 | 9/1968 | Stone | 206/462 |
| 3,480,138 | 11/1969 | Baker | 206/461 |
| 3,990,578 | 11/1976 | Roeser | 206/461 |
| 4,133,023 | 1/1979 | Hanson | 362/11 |
| 4,158,879 | 6/1979 | Peterson | 362/11 |

*Primary Examiner*—William T. Dixson, Jr.
*Attorney, Agent, or Firm*—Norman C. Fulmer; Lawrence R. Kempton; Philip L. Schlamp

[57] ABSTRACT

A FlipFlash type of flash array having a body portion and a pair of connectors extending from opposite ends of the body portion and offset from the front face of the body portion, is packaged in a display sheet having an opening through which the front part of the body portion is inserted, the connectors being adjacent to the rear surface of the display sheet. The package includes a member extending over the rear of the flash array.

4 Claims, 7 Drawing Figures

Fig. 1
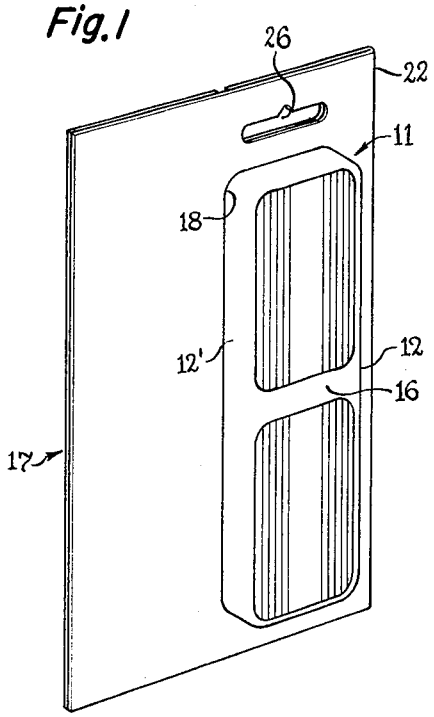
Fig. 2
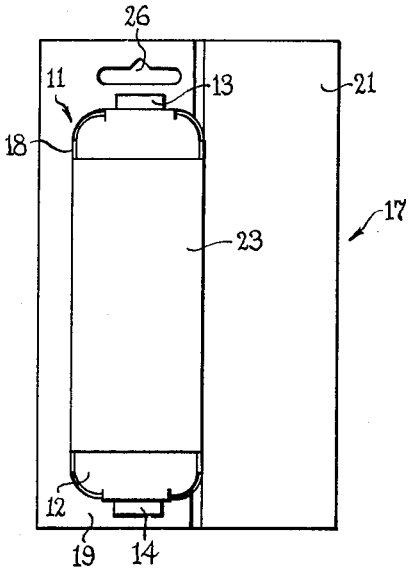
Fig. 3
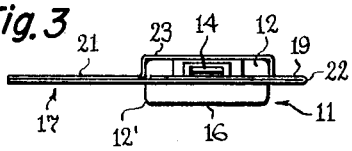
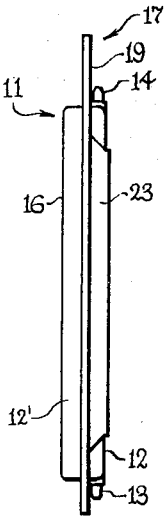
Fig. 4

FLASH ARRAY PACKAGE

BACKGROUND OF THE INVENTION

The invention is in the field of photoflash array packaging.

Photoflash arrays, such as the FlipFlash type, have been packaged in cardboard boxes which are attached to cardboard sheets having openings near the top for hanging on display hooks in stores. Trademarks and other information are printed on the box and on the sheet. One or more openings are provided through the front of the box for displaying part of the flash array to prospective purchasers.

SUMMARY OF THE INVENTION

An object of the invention is to provide an improved flash array package which displays the array in an attractive and pleasing manner, to enhance sales thereof.

The invention comprises, briefly and in a preferred embodiment, packaging of a photo lamp array of the type having a body portion and a pair of connectors extending from opposite ends of the body portion and offset from the front face of the body portion. The connectors are for connecting the array to a camera, in different orientations. The packaging comprises a display sheet such as chipboard or cardboard provided with an opening through which the front part of the array's body portion is inserted, so that the connectors are adjacent to the rear surface of the display sheet. The package includes a member extending over the rear of the flash array for holding the array in the package in cooperation with the aforesaid adjacency of the connectors to the display sheet and protrusion of the body portion through the opening. The member extending over the rear of the flash array may be a portion of the display sheet which is folded back on itself, or alternatively may comprise a contoured transparent blister-pack sheet material adhered at its edges to the rear of the display sheet.

BRIEF DESCRIPTION OF THE DRAWING

FIG. 1 is a perspective view of a preferred embodiment of the flash array packaging, looking toward the front thereof.

FIGS. 2, 3, and 4 are rear, end, and side views, respectively, of FIG. 1.

DESCRIPTION OF THE PREFERRED EMBODIMENT

Figure 5:
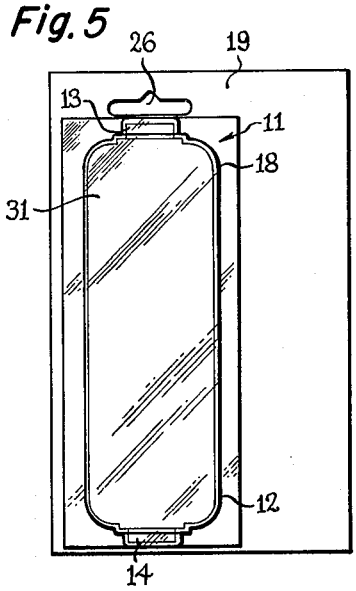
FIGS. 5, 6 and 7 are rear, side, and end views, respectively, of an alternative preferred embodiment of the invention.

The drawing shows preferred embodiments of a package for a photoflash lamp array 11 of the type comprising a body portion 12, shown as an elongated rectangular configuration in the preferred embodiments. Connectors 13 and 14 extend respectively from the ends of the body portion 12, for the purpose of plugging the flash array 12 into a camera socket in different orientations. The connectors 13 and 14 are offset from the front face 16 of the body portion 12 extends frontwardly of the connectors 13 and 14. The flash array 11 shown in the drawing is known as a FlipFlash array, and an embodiment thereof is more fully disclosed in U.S. patent application Ser. No. 860,438, filed Dec. 14, 1977, James M. Hanson, "Flash Lamp Array Having Electrical Shield".

A display sheet 17, which may be of chipboard or cardboard or other suitable material, is provided with an opening 18 therethrough, and through which the front part 12' of the flash array's body portion 12 is inserted, so that the connectors 13 and 14 are adjacent to the rear surface 19 of the display sheet 17. As mentioned above, the package includes a member extending over the rear of the flash array for holding the array in the package, in cooperation with the aforesaid adjacency of the connectors to the rear of the display sheet and the protrusion of the body portion through the opening 18. In the embodiment of FIGS. 1 through 4, this member comprises an extension 21 of the display sheet 17, and the display sheet is folded back on itself at 22, the extension 21 being configured in a bracket-like shape 23 so as to fit around and over the rear portion of the body member 12, as shown. The portion of the extension 21 remote from the fold 22 abuts against the rear of the display sheet, and is adhered thereto such as by adhesive. The bracket-like configuration 23 of the extension 21 holds the flash array 11 to the display sheet 17, in cooperation with the aforesaid adjacency of the connectors 13 and 14 to the rear surface 19 of the display sheet 17, and also in cooperation with the front portion 12' of the body portion 12 extending through the opening 18 of the display sheet 17, whereby the flash array 11 is reliably held in and by the display sheet 17. In the embodiment shown, portions of the extension sheet 21 lie under the connectors 13 and 14 and thereby constitute the rear surface of the display sheet 11 with respect to which the connectors 13 and 14 are adjacent. This adjacency may be a touching contact, or a spaced adjacency, depending upon the tightness of the bracket-shaped portion 23 of the extension 21 around and against the flash array 11.

An opening 26 is provided through the display sheet 17 near the upper end thereof, for hanging the packaged flash array on a display hook in a store. The front and rear surfaces of the display sheet 17 may be provided with trademarks and other printed information.

By packaging the flash array 11 as shown in the drawing and as above described, with its entire front portion extending frontwardly of the display sheet 17 and being uncovered so as to be in full view of potential purchasers for their inspection, the packaging is more appealing and is an improvement over the prior boxed packaging of flash arrays.

Figure 7:
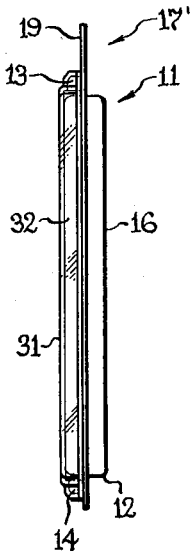
Figure 6:
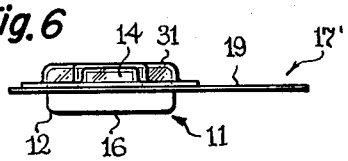

The embodiment of FIGS. 5 through 7 is the same as that of FIGS. 1 through 4, except that the extension 21 of the display sheet is omitted, and instead of the holding bracket 23 at the rear of the flash array, there is provided a transparent "blister pack" type of plastic sheet 31 (such as polyvinyl chloride) contoured to fit over the rear part of the body member 12 which lies behind the display sheet 17". The outer edges of the transparent sheet 31 lie against and are adhered to the rear surface of the display sheet 17. This embodiment has the advantage that the entire rear portion of the flash array 11 is visible to prospective purchasers, as well as the entire front portion of the array being visible, thus further enhancing the attractiveness of the packaging.

While preferred embodiments of the invention have been shown and described, various other embodiments and modifications will become apparent to persons skilled in the art, and will fall within the scope of the invention as defined in the following claims.

What we claim as new and desire to secure by United States Letters Patent is:

1. A packaged photoflash array, said array comprising a body portion having a front face, and a pair of connectors extending from opposite ends of said body portion and offset rearwardly from said front face, and a display sheet provided with an opening through which the front part of said body portion is inserted, said connectors being adjacent to the rear surface of said display sheet, and a member extending over the rear of said flash array for holding said array in said display sheet in cooperation with said insertion of the front part of the body portion through the opening and said adjacency of the connectors to the rear surface of the display sheet, said front part of the body portion of the array being uncovered so as to be in full view for inspection.

2. A packaged array as claimed in claim 1, in which said member extending over the rear of the array comprises an extension of said display sheet which is folded over and adhered to the rear surface of the display sheet.

3. A packaged array as claimed in claim 2, in which said extension is contoured to form a bracket around the rear part of said flash array.

4. A packaged array as claimed in claim 1, in which said member extending over the rear of the array comprises a transparent sheet contoured so that its edge regions are against said rear surface of the display sheet, and means attaching said edge regions to said rear surface.

* * * * *